United States Patent [19]

Appleman

[11] 4,047,578

[45] Sept. 13, 1977

[54] PORTABLE EARTH BORING MACHINE

[75] Inventor: William S. Appleman, Ashland, Ohio

[73] Assignee: The Richmond Manufacturing Company, Ashland, Ohio

[21] Appl. No.: 591,642

[22] Filed: June 30, 1975

Related U.S. Application Data

[63] Continuation-in-part of Ser. No. 455,388, March 27, 1974, Pat. No. 3,907,043.

[51] Int. Cl.[2] ..... E21D 9/02; E02D 7/28

[52] U.S. Cl. ..... 173/152; 60/489; 173/43; 175/170

[58] Field of Search ..... 173/152, 43; 175/122, 175/170, 171; 60/489, DIG. 2, 486

[56] References Cited

U.S. PATENT DOCUMENTS

| | | | |
|---|---|---|---|
| 3,678,684 | 7/1972 | Sorensen | 60/DIG. 2 |
| 3,682,253 | 8/1972 | McIntosh | 173/43 X |
| 3,833,072 | 9/1974 | Back | 175/171 X |
| 3,869,003 | 3/1975 | Yamada | 175/171 |
| 3,870,110 | 3/1975 | Appleman et al. | 175/171 X |
| 3,912,024 | 10/1975 | Richmond et al. | 173/152 |
| 4,864,915 | 2/1975 | Metailler | 60/DIG. 2 |

*Primary Examiner*—Ernest R. Purser
*Assistant Examiner*—William F. Pate, III

[57] ABSTRACT

A portable earth boring machine for the boring of vertically inclined shafts and the insertion of pipeline casing sections characterized by a main frame portion that supports the auger drive and casing pusher apparatus, and a detachably mounted engine frame portion that permits the transmission of power between the engine and the auger drive and casing pusher apparatus not only when the engine frame portion is positioned on the main frame portion at the boring location but also when said engine frame portion is detached and positioned at a location remote from the main frame means. The machine is further characterized by a novel control means for the auger drive apparatus that provides for remote operation and hydraulically actuated variable speed control of the boring auger.

2 Claims, 7 Drawing Figures

FIG. 2-A.

PORTABLE EARTH BORING MACHINE

REFERENCE TO CO-PENDING APPLICATION

This application is a continuation-in-part of my co-pending application Ser. No. 455,388 filed Mar. 27, 1974 now U.S. Pat. No. 3,907,043.

BACKGROUND OF THE INVENTION

This invention relates to portable earth boring machines and more particularly to a machine adapted for the boring of shafts for the insertion of pipelines with said machine being adapted for remote control operation.

SUMMARY OF THE INVENTION

In general, the earth boring machine of the present invention comprises a base means that includes spaced track members which are vertically adjustable to various angles of inclination so as to adapt the boring machine for drilling holes and pushing casing sections into the earth at various selected angles of inclination. The machine further includes a frame means mounted for movement along the track means and such frame means supports a power train for rotating connected sections of auger shafts which comprise a progressively extendable boring auger. The frame means further supports a pusher ring for driving sections of casings into the bored hole and an associated pushing cylinder means is provided for advancing and retracting the frame means and pusher ring along the track means.

With machines of this general type problems have been encountered in the function of driving the boring auger into various types of earth fill which may comprise anything from hard rock to soft earth. Prior boring machines have been characterized by power trains connecting the auger with the engine which power trains have included mechanical transmissions and speed reducer mechanisms for the purpose of providing a multiplicity of speeds, for example two or three, for selective use with various earth fill characteristics. However, due to the many types of earth fill encountered, including rock formations of various hardness, the several available gear ratios available in prior machines have in most cases necessitated compromises in optimum auger speeds with resulting inefficiency and slow down in production rates.

In accordance with the present invention the earth boring machine is adapted for operation at various angles of inclination and provided with remote control apparatus for control of the machine by an operator in a remote location.

As another aspect of the present invention, the boring machine is provided with a novel infinitely variable hydraulic drive in the power train permitting the operator to select an infinite number of speeds within the available range from zero to maximum.

As another aspect of the present invention the novel control system is selectively controllable with the engine frame portion and associated apparatus either in position on the main frame of the machine, or with such engine frame portion positioned at a remote location such as outside the trench from which the tunnel is being bored.

As still another aspect of the present invention the novel control means is provided with a maximum high pressure relief valve means which prevents the operator from at anytime overloading the components of the fluid circuit.

It is therefore a primary object of the present invention to provide a novel earth boring machine adapted for operation at various angles of inclination so as to permit the boring of vertically extending shafts as well as the pushing of casing sections into said shafts.

It is another object of the present invention to provide an earth boring machine with a novel control system for the speed of the boring auger which permits the operator to infinitely vary the auger speed to establish the most efficient boring rate for the particular earth conditions being encountered.

It is another object of the present invention to provide a boaring machine with a control system of the type described that is uniquely adapted for remote control operation such that the engine frame portion and associated apparatus can be positioned outside the boring trench.

It is still another object of the present invention to provide a boring machine with a hydraulic control system of the type described which includes safety means for preventing the operator from anytime overloading the hydraulic system.

Further objects and advantages of the present invention will be apparent from the following description, reference being had to the accompanying drawings wherein a preferred form of embodiment of the invention is clearly shown.

BRIEF DESCRIPTION OF THE DRAWINGS

FIG. 2-A is a perspective view of a control station for the machine of the present invention;

DESCRIPTION OF THE PREFERRED EMBODIMENT

Figure 1:
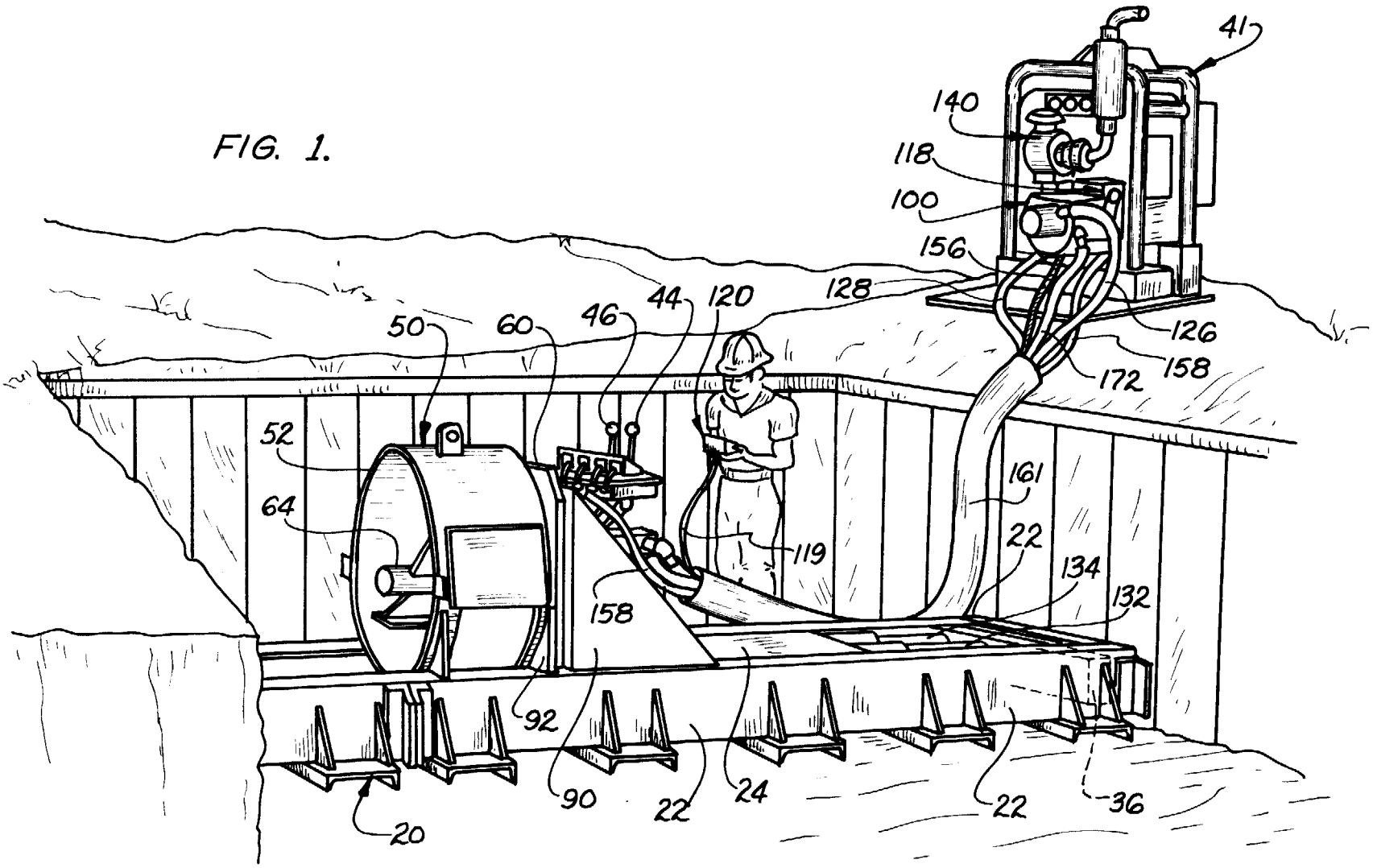
FIG. 1 is a perspective view of a boring machine constructed in accordance with the present invention and showing the main frame portion of such machine disposed in a trench in a boring position with the removable engine frame portion positioned outside the trench.
Figure 2:
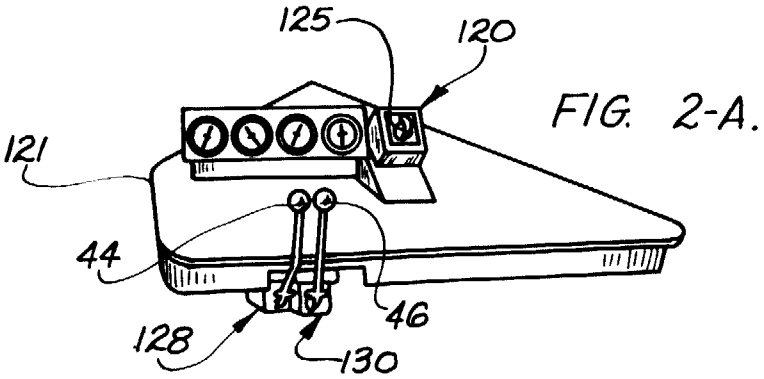
FIG. 2 is a side elevational view of the boring machine of FIG. 1.
Figure 2:
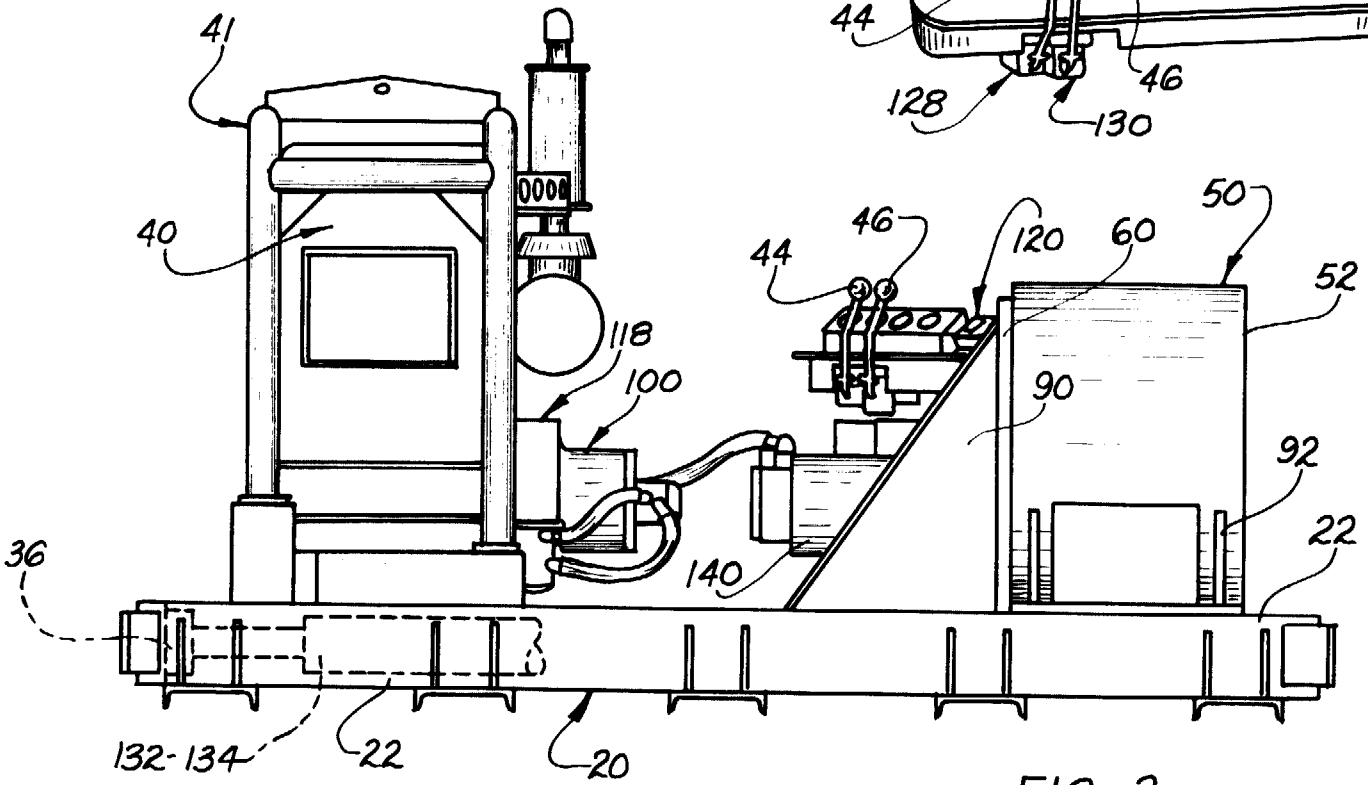

Referring in detail to the drawings, FIGS. 1 and 2 illustrate the complete horizontal earth boring machine of the present invention which comprises a base means indicated generally at 20. Such base means includes spaced longitudinally extending track means 22 which support carriage means indicated generally at 24.

The carriage means 24 is advanced and retracted along track 22 by hydraulic power cylinders, portions of which are seen at 132 and 134 in FIG. 1. With such power cylinder being operatively connected between a power cylinder base 36 and the carriage means 24.

Details of typical power cylinders such as 132 and 134 and power cylinder base 36 are disclosed and described in detail in the application of Albert R. Richmond, Ser. No. 867,816 filed Oct. 20, 1969, now U.S. Pat. No. 3,612,195 issued Nov. 12, 1971.

It will be further seen that pressurized fluid for actuating power cylinder 132 and 134 is provided by a fluid power system disclosed and described in detail in our co-pending application Ser. No. 591,641 filed June 30, 1975. In general such circuits include valve mechanisms 44 and 46 which actuate and pushing cylinder 132 and 134 so as to extend or retract carriage 24 forwardly or rearwardly along the track means 22.

Referring again to FIG. 1, the boring machine further includes a pusher ring 50 including a front annular surface 52 for engaging the sections of pipe casing for pushing such sections into the bored hole. Such pusher ring 50 includes a thrust plate 60 mounted on the carriage means with such thrust plate 51 serving as a mount for a thrust bearing, not illustrated, for the auger connecting shaft 64. The mechanism comprising the thrust plate 60, the thrust bearing assembly mounted thereon, and the back-up plates 90 transmit the thrust from the auger connecting shaft 64 to the carriage means 24 and thereby isolate the power train from the thrust.

A typical auger construction for connection with the machine of the present invention is disclosed and described in detail in the application of Albert R. Richmond, Ser. No. 85,614 filed Oct. 30, 1970, now U.S. Pat. No. 3,693,734 issued Sept. 26, 1972.

Figure 3:
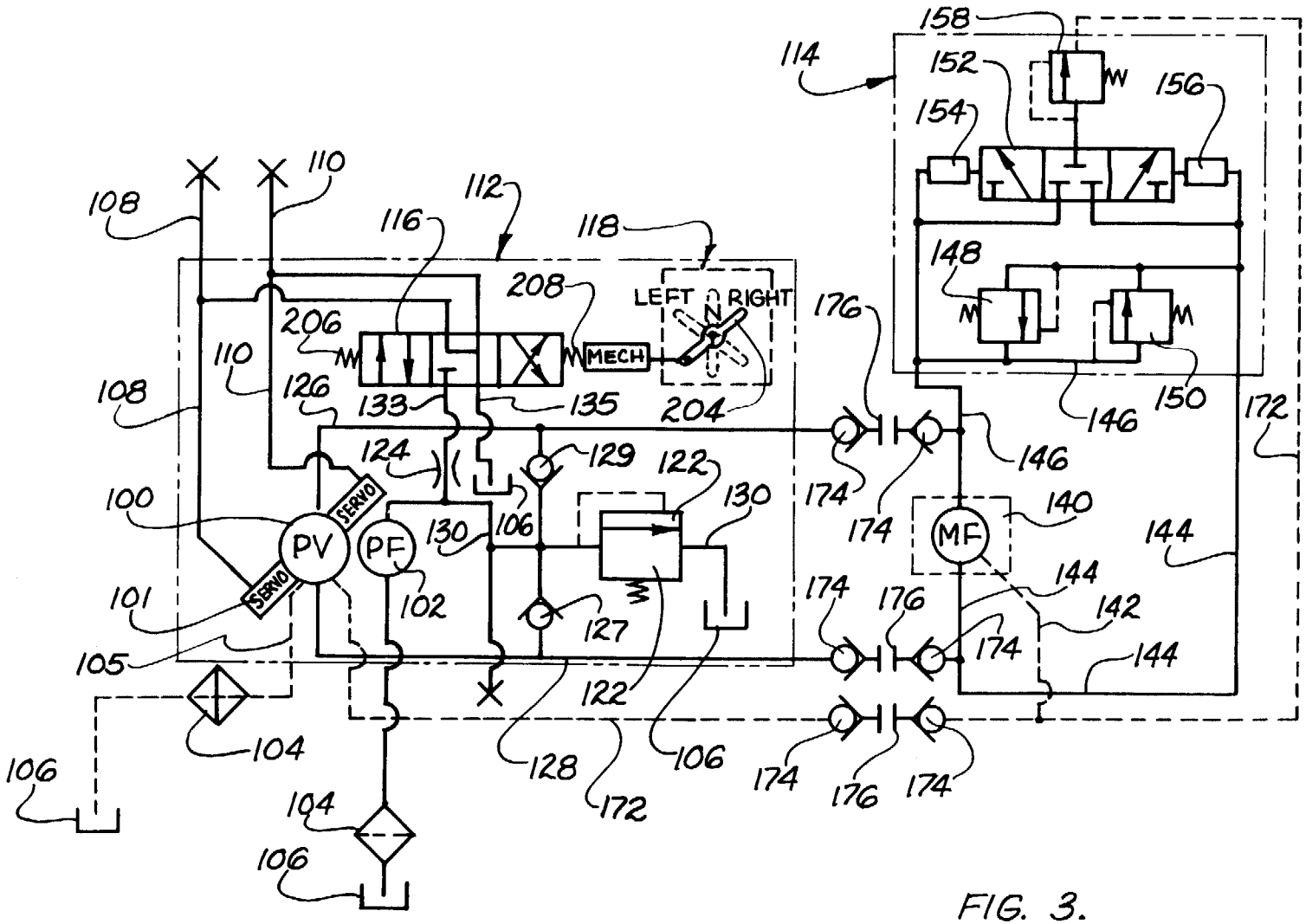
FIG. 3 is a diagrammatic view of a hydraulic circuit comprising the control means for the machine of the present invention.

Reference is next made to FIG. 3 which is a diagrammatic view of the hydraulic system for controlling the operation of the boring auger drive including the speed and reversal of auger connecting shaft 64. A variable displacement pump indicated generally at 100 is driven by an engine indicated generally at 40 and mounted on an auxiliary frame means 41 as seen in FIGS. 1 and 2. Pump 100 receives fluid from a reservoir 106, with variable pump 100, line 126, line 128, line 144, line 146 and a fixed displacement hydraulic motor 140 constituting a closed loop circuit. It will be understood that motor 140, FIG. 2, drives the previously described auger connecting shaft means 64, FIG. 1.

During forward operation of the boring auger shaft 64, pressurized hydraulic fluid is delivered from pump 100 via pressurized lines 126 and 147 to motor 140 and returned to the pump via lines 144 and 128. For reverse operation of the auger connecting shaft 64 the variable displacement pump 100 is reversed and the flow through the closed loop circuitry is in the opposite direction.

In general, variation in flow volume and reversal of variable pump 100 is accomplished by a servo-circuit which functions to vary the angle of a conventional wobbleplate in the pump, or other means conventional in the art. Such wobble plate is actuated by a small hydraulic servo motor usually integral with the pump with such servo motor mechanism being indicated at 101 in FIG. 3. The circuit for operating servo motor 101 and hence controlling displacement and reversal of variable pump 100 further includes a fixed displacement pump 102, a fixed flow control valve 124, and a pump control valve 116.

Reference is next made to the operation of the servo circuit for controlling variable displacement pump 100 and hence the speed and direction of hydraulic motor 140. Pump control valve 116 is a normally closed three-position valve which when actuated by arm 204 from centered to right or left positions functions to deliver pressurized oil either to one side of servo motor 101 via lines 133 and 108 or to the other side via lines 133 and 110. The spool of valve 116 is normally biased to its center position by springs 206 and 208.

Figure 4:
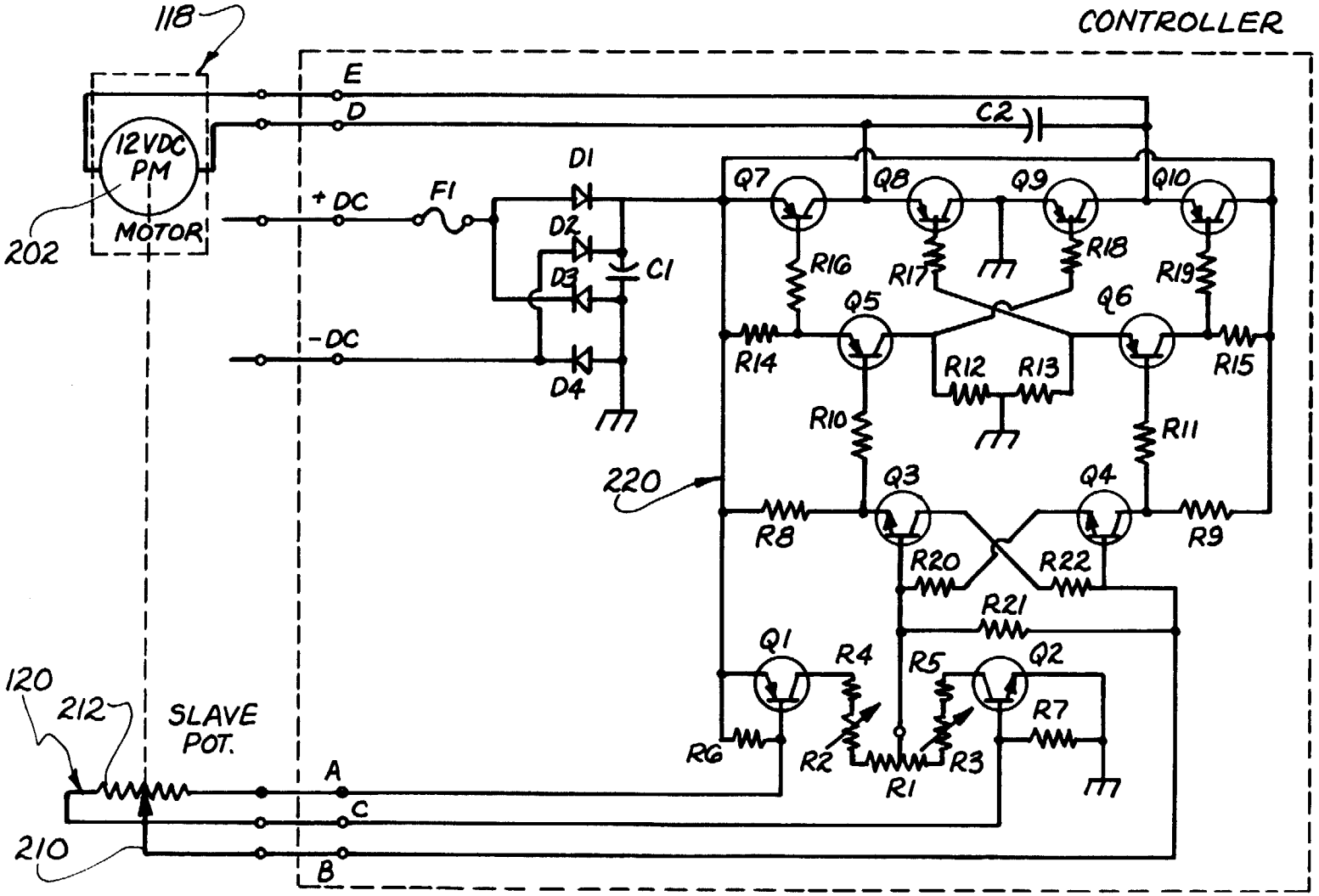
FIG. 4 is a diagrammatic view of an electronic circuit comprising the controller for the machine of the present invention.

It should next be mentioned that pump control valve 116 is provided with remote control apparatus 118–120, FIGS. 3 and 4, which apparatus comprises a servo actuator 118, that includes an electric motor 202 mounted at valve 116 which merely functions to move valve arm 204 between the above mentioned "centered" or neutral position, and right and left valve positions. The remote control apparatus further includes a remote electric controller 120, FIGS. 1, 2, and 2-A which is normally removably mounted on a control console 121. In remote operation, FIGS. 1, the remote electric controller 120 is removed from console 121 and carried about by the operator as seen in FIG. 1. The function of remote electric controller 120 is to operate the previously mentioned electric motor 202 in servo actuator 118 and the controller 120 and actuator 118 are connected together by wires 119 as seen in FIG. 1. In general, when a dial knob 126 on controller 120 is turned then a contact 210 of the slave potentiometer, FIG. 4, is moved with respect to a resistor 212 which serves to vary the resistance. More particularly, when dial 126 is turned from a "O" or center position in one direction by the operator, then the current in the armature of motor 202 in servo actuator 118 is varied so as to drive the spool of pump control valve 116 from its "center" position to its "right" position. Similarly, when dial knob 126 is turned from its center position in the other direction electric motor 202 in servo actuator 118 moves the spool in pump control valve from its "center" position to its "left" position.

Referring particularly to FIG. 4, this represents an appropriate circuit which includes a transistor network indicated generally at 220. Such transistor network functions to vary the potential in the armature of motor 202 which motor is of the permanent magnet D.C. type responsive to movement of contact 210 of a slave potentiometer along the resistor 212. When such contact 210, and the previously mentioned dial 125 which moves it, FIGS. 2 and 2-A, are centered the potential supplied by transitor network 220 balances the field and armature of motor 202 and the motor is stationary with valve actuating arm 204 in its centered position as seen in FIG. 2-A.

When the dial 125 is moved from "O" or centered position to the left then the transistor network 220 varies the potential in the armature of motor 202 and the motor rotates to move valve control arm 204, FIG. 3, to the left.

Valve 116 then delivers pressurized fluid to servo control 101 of variable pump 100 and the wobble plate of the pump is msoved in a conventional manner to cause the delivery of pressurized fluid to drive motor 140 in the forward direction. It will now be seen that the more dial 125 is rotated from "O" to the left, the faster motor 140 will rotate in a forward direction.

Conversely, when dial 125, FIG. 2 and FIG. 2-A is rotated from "O" to right, then movable contact 210 is driven to the right with a resulting change in potential in the armature of motor 202. Valve actuating arm 204 is moved progressively to the right whereby pump 100 and motor 140 are driven in the reverse direction.

It will also be understood that when dial 125 is moved back from "left" or "right" to "center" then motor 202 will center pump 100 and rotation of motor 140 and the auger shaft 64 will cease.

It will now be understood that dial knob 125 of controller 120 permits the operator to set the pump control servo motor 101 at an infinite number of settings within its range from zero to maximum. Hence the settings for flow output from pump 100 and hence the directional rotational speed of motor 140 and the boring auger driven thereby are infinitely variable within the established range from zero to maximum rotational speed.

With continued reference to FIG. 3, fixed pump 102 further serves to charge the previously mentioned closed loop circuit via lines 130 and check valves 129 and 127. When one of the check valves 126 or 127 is on the pressure side of the closed loop then it will be biased closed and hence oil from line 130 can only be released from the opposite one of the check valves 129 or 127 to the low pressure side of the closed loop.

A pressure relief valve 122 is provided in line 130 for releasing excess fluid delivery from fixed pump 102 back to tank.

Hence when no make-up oil is required in the low pressure side of the closed loop, that is line 129 or line 128, then relief valve 122 permits the fluid from pump 102 to by-pass back to tank 106.

Referring again to FIG. 3, the closed loop circuit between pump 100 and motor 140 is pressure relieved by a pair of oppositely acting relief valves 148 and 150 which connect to the closed loop on opposite sides of motor 140 via the lines 146 and 144. These relief valves 148 and 150 are arranged such that if the high pressure side of the closed loop becomes excessive the appropriate one of such relief valves 148 or 150 will remove fluid into the low pressure side of the closed loop without losing oil from the loop circuit.

With continued reference to FIG. 3, a pilot operated shuttle valve 152 which includes the pressure actuated pilots 154 and 156 is provided to prevent the build-up of excess pressure within the housing of motor 140 due to the occurrence of leakage and high pressure air around the pistons of the pump.

Pilot operated shuttle valve 152 is shifted upon occurrence of high pressure on the high pressure side of the closed loop circuit so as to open the low pressure side of the closed loop circuit to a surge flow relief valve 158. For example, if during forward operation and line 126 of the of the closed loop circuit is pressurized then pilot 154 shifts shuttle valve 152 so as to expose the other side of the circuit, the low pressure side, to surge flow relief flow 158 thereby protecting the low pressure side of the pump-motor circuit from any excessive surge pressures which may occur.

When motor 140 is operating in the opposite direction then the other pilot 156 shifts power operated shuttle valve 152 in the opposite direction thereby opening the other side of the closed loop circuit to relief valve 158. It should be mentioned that any fluid released from relief valve 158 returns hydraulic fluid back to tank via line 172, the cooling chamber of pump 100, line 105, and an oil cooler 104.

It should further be mentioned that the housing of fluid motor 144 is prevented from the build-up of excess pressure due to the leakage past the pistons of the motor via a return line 142 which connects with line 172 leading back to tank 101.

With reference to FIGS. 1 and 3, the fluid lines 126, 128, and 172 are extended through the remote control loom 161, along with the wires 119 which connect remote electric controller 120 with the servo actuator 118 as previously described. Also the fluid lines 126, 128 and 172 are preferably provided with quick disconnect couplings 174–176 as seen in FIG. 3.

Figure 5:
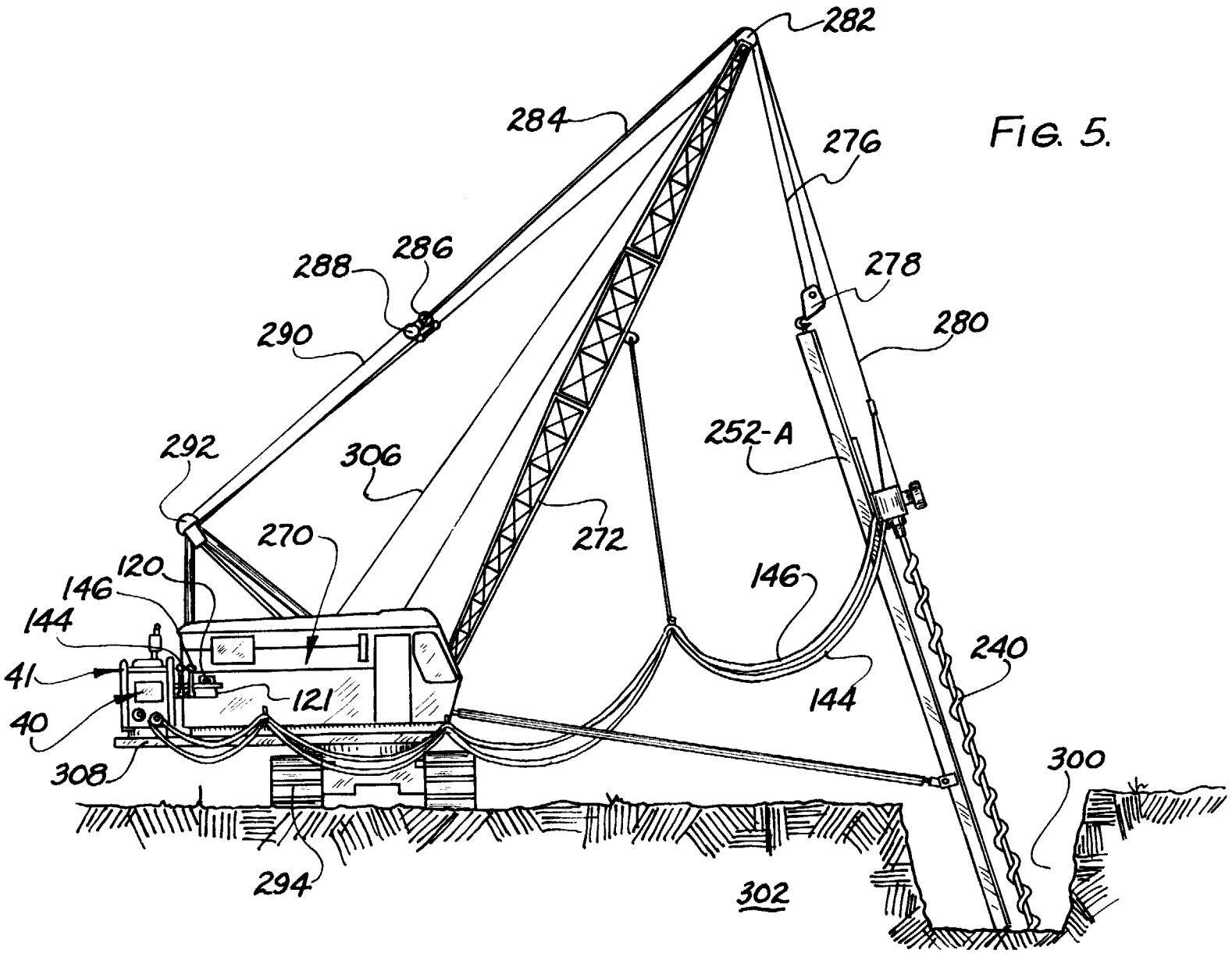
FIG. 5 is a side elevational view, partially in section, of a modified boring machine constructed in accordance with the present invention and adapted for vertically inclined boring operations.

Reference is next made to FIG. 5 which illustrates a modified boring machine constructed in accordance with the present invention, such machine being adapted for the boring of vertically inclined holes such as the holes 248, FIG. 5.

With continued reference to FIG. 5, the vertical boring apparatus comprises inclined track supporting frame members 252 which are pivotally mounted on a base 250 at the pivot 260. The angle of inclination of vertically inclined frame members 252 is selectively varied by the extension or retraction of a telescoping power cylinder 254. This cylinder has its base end mounted to base means 250 at a pivot 258 and its rod end mounted to inclined frame members 252 at pivot 236. Telescoping power cylinder 254 is connected to a source of pressurized fluid and reservoir via lines 266 and 264 respectively. Hence it will be understood that the extension and retraction of telescoping cylinder 254 is remotely controlled by a conventional control valve, not illustrated, which may be positioned at the auxiliary frame means 41 or at any other remote location.

With continued reference to FIG. 5, the previously mentioned spaced track members 22, FIG. 1, are mounted on the vertically extending frame members 252 and the casing pusher ring 50 is advanced and retracted by the pushing cylinders 132–134 for the purpose of pushing the casing sections such as 236 and 238 into the bored hole.

With continued reference to FIG. 5, this view further illustrates the earth boring auger sections 242 which are added as the boring progresses as well as a front cutting head 244.

The operation of the vertical embodiment of FIG. 5 is similar to the embodiment previously described wherein the manual actuator 144 and 146 are actuated by the operator for the purpose of extending and retracting pushing cylinders 132 and 134 whereby the casing pusher ring 50 and thrust plate 160 are advanced and retracted so as to permit the insertion of successive casing sections 236–238 as the boring of the hole progresses. The control circuit for such pushing cylinders is described in detail in my co-pending application Ser. No. 455,254 filed Mar. 27, 1974.

It should be mentioned that boring auger 242 is driven by a fluid motor 140 which is in turn driven by a variable volume pump 100 and utilizes the previously described control circuit of FIG. 3.

It should be further mentioned that the variable speed drive for the auger 242 is remotely controlled by the remote manual electric controller 120 incorporated in the electric circuit of FIG. 4 previously described herein. Manual electric controller 120 can be removed from console 121 and carried around by the operator as shown in FIG. 1.

Referring again to FIG. 5, the casing pusher ring 50 is provided with an earth discharge opening 230 with the drillings from the auger 242 being continuously discharged from such opening by the rotating blades 232 mounted on the auger connecting shaft means.

Figure 6:
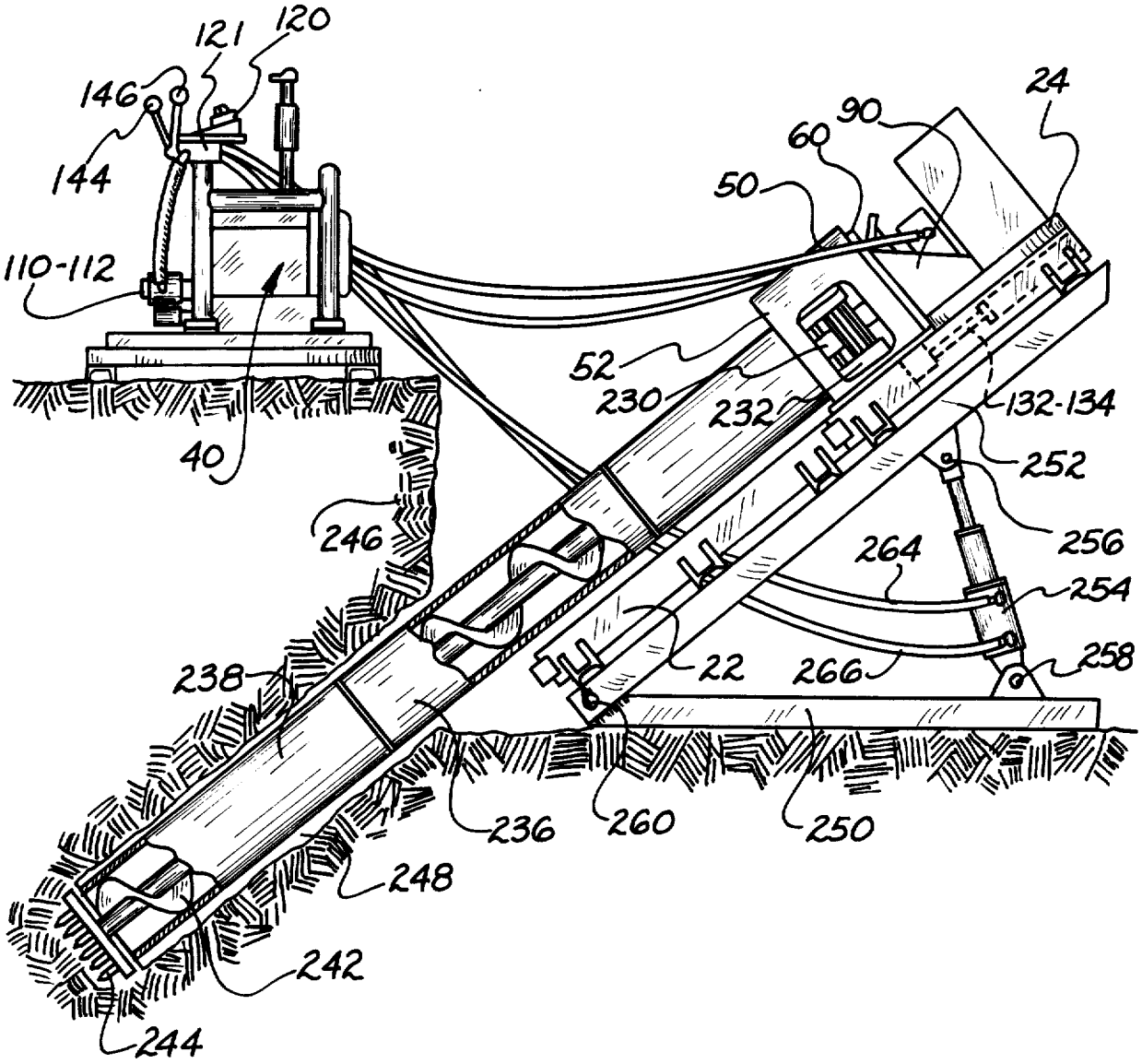
FIG. 6 is a side elevational view of a second modified boring apparatus constructed in accordance with the present invention and adapted for use with a crane for effecting vertically inclined boring operations.

Reference is next made to FIG. 6 which illustrates another modified boring apparatus constructed in accordance with the present invention. In this embodiment vertically inclined track members 252-A are utilized to adapt the previously described fluid motor 140 for driving the auger assembly 240. The apparatus utilizes a conventional crane indicated generally at 270 which includes a boom 272 which can be manipulated via the cables 306 so as to position the track members 252-A in a vertically inclined position. The track means 252-A can also be manipulated via a cable 276 and pulley apparatus 278 with said cable being extended and retracted in the conventional manner by the conventional power windless on the crane. The apparatus is further provided with a track brace 310 which can be connected to inclined track means 252-A at the pivot 312 with such track brace functioning to add rigidity to the assembly.

With continued reference to FIG. 6, fluid motor 140 can be moved along track means 52-A by the action of gravity and by the lifting action of a cable 280 driven by a conventional windless on crane 270.

It should be mentioned that auger assembly 240 is progressively extended as the drilling progresses by the addition of individual auger sections such as the section 242.

With continued reference to FIG. 6 the previously mentioned auxiliary frame 41 is shown mounted on the rear of the crane frame 308 with the previously described variable volume pump 100 driven by power unit engine 40 with said pump being connected in circuit with fluid motor 140 via the lines 144 and 146.

Here again, in the embodiment of FIG. 6 the control circuit of FIG. 3 is utilized to vary the speed of rotation of the auger assembly 240 with such control circuit utilizing the circuit portion indicated generally at 114 which may be connected at the disconnect couplings 176 from the control circuit portion 118, all as seen in FIG. 3. It should further be mentioned that the manual electric controller 120 is shown removably positioned on the controller console 121 shown mounted on auxiliary frame means 41. It will be understood that the electric controller 120 can be picked up and carried about by the operator for controlling the variable speed drive from various locations in the manner shown in FIG. 1.

While the forms of embodiments of the present invention as herein disclosed constitute preferred forms, it is to be understood that other forms might be adopted.

What is claimed is:

1. An earth boring apparatus for drilling vertically extending holes and pushing casing sections therein, said apparatus comprising, in combination, vertically extending track means; main frame means mounted for movement along said track means; a fluid motor mounted on said main frame means; auger connecting shaft means driven by said fluid motor; auxiliary frame means for disposition at a location remote from said main frame means; an engine mounted on said auxiliary frame means; variable displacement pump means mounted on said auxiliary frame means and driven by said engine; conduit means forming a closed loop circuit between said pump means and said fluid motor; a servo motor for varying the displacement of said pump means; pump control valve means for controlling a control flow of pressurized fluid to said servo motor, said valve means including a "center" position isolating said fluid motor from said control flow, a "right" position for delivering said control flow to one side of said servo motor, and a "left" position for delivering said control flow to the other side of said servo motor; manually operated control means for actuating said pump control valve means, said closed loop circuit including a first circuit portion that is alternately exposed to high and low pressure, and a second circuit portion that is alternately exposed to high and low pressure; a second pump means for charging said closed loop circuit with make-up fluid; and check valve means for selectively releasing said make-up fluid to whichever one of the circuit portions is operating at low pressure.

2. An earth boring apparatus for drilling vertically extending holes, said apparatus comprising, in combination, vertically extending track means; main frame means mounted for movement along said track means; a fluid motor mounted on said main frame means; auger connecting shaft means driven by said fluid motor; a crane including a boom and cable apparatus for manipulating said track means and the main frame means mounted thereon, auxiliary frame means for disposition at a location remote from said main frame means; an engine mounted on said auxiliary frame means; variable displacement pump means mounted on said auxiliary frame means and driven by said engine; conduit means forming a closed loop circuit between said pump means and said fluid motor; a servo motor for varying the displacement of said pump means; pump control valve means for controlling a control flow of pressurized fluid to said servo motor, said valve means including a "center" position isolating said fluid motor from said control flow, a "right" position for delivering said control flow to one side of said servo motor, and a "left" position for delivering said control flow to the other side of said servo motor; manually operated control means for actuating said pump control valve means, said closed loop circuit including a first circuit portion that is alternately exposed to high and low pressure, and a second circuit portion that is alternately exposed to high and low pressure; a second pump means for charging said closed loop circuit with make-up fluid; and check valve means for selectively releasing said make-up fluid to whichever one of the circuit portions is operating at low pressure.

* * * * *